US008220987B2

(12) United States Patent
Kimura et al.

(10) Patent No.: US 8,220,987 B2
(45) Date of Patent: Jul. 17, 2012

(54) ROTATION SWITCH AND ELECTRONIC TIMEPIECE

(75) Inventors: Soh Kimura, Kodaira (JP); Syuuichi Machida, Ome (JP)

(73) Assignee: Casio Computer., Ltd., Tokyo (JP)

( * ) Notice: Subject to any disclaimer, the term of this patent is extended or adjusted under 35 U.S.C. 154(b) by 11 days.

(21) Appl. No.: 12/791,189

(22) Filed: Jun. 1, 2010

(65) Prior Publication Data

US 2010/0309756 A1 Dec. 9, 2010

(30) Foreign Application Priority Data

Jun. 9, 2009 (JP) ..... 2009-138159

(51) Int. Cl.
*G04B 29/00* (2006.01)
*G04B 43/00* (2006.01)

(52) U.S. Cl. ..... 368/319; 368/293

(58) Field of Classification Search ..... 368/293, 368/320–321
See application file for complete search history.

(56) References Cited

U.S. PATENT DOCUMENTS 4,038,814 A * 8/1977 Niida ..... 368/69
4,423,342 A * 12/1983 Mokdad ..... 310/41
5,572,489 A * 11/1996 Born et al. ..... 368/21
6,134,189 A * 10/2000 Carrard ..... 368/69
7,404,667 B2 * 7/2008 Born et al. ..... 368/190
7,520,664 B2 * 4/2009 Wai ..... 368/190
2008/0112275 A1 5/2008 Born et al.
2010/0142331 A1 6/2010 Kimura et al.

FOREIGN PATENT DOCUMENTS

EP 2 196 871 A2 6/2010
JP 53-012089 A 2/1978
JP 63-134429 A 6/1988
JP 10-300763 A 11/1998
JP 2008-122377 A 5/2008

OTHER PUBLICATIONS

Japanese Office Action dated Sep. 12, 2011 (and English translation thereof) in counterpart Japanese Application No. 2009-138159.

* cited by examiner

*Primary Examiner* — Sean Kayes

(74) *Attorney, Agent, or Firm* — Holtz, Holtz, Goodman & Chick P.C.

(57) ABSTRACT

A rotation switch includes an operating member that is operable to rotate, a magnet member that rotates integrally with the operating member, a magnetic sensor that is placed opposite to the magnet member, and a frame-shaped magnetic shield plate that surrounds the periphery of the magnetic sensor.

10 Claims, 10 Drawing Sheets

ROTATION SWITCH AND ELECTRONIC TIMEPIECE

CROSS-REFERENCE TO RELATED APPLICATION

This application is based upon and claims the benefit of priority from the prior Japanese Patent Application No. 2009-138159, filed Jun. 9, 2009, the entire contents of which is incorporated herein by reference.

BACKGROUND OF THE INVENTION

1. Field of the Invention

The present invention relates to a rotation switch and an electronic timepiece.

2. Description of the Related Art

An electronic wristwatch, for example, is configured such that the stem is pulled outward to a predetermined position and rotated so that the hands thereof move corresponding to the rotation of the stem for time adjustment. As a time adjusting device for an electronic wristwatch such as this, a device configured as described in United States Patent Application. Publication No. 2008/0112275 is known in which the wristwatch case is provided with a stem that is movable to a first position and a second position in an axial direction thereof and rotatable in the direction of rotation around the axis of the stem, and magnetic sensors positioned in the circumferential direction of magnets provided in the stem are provided inside the wristwatch case.

In this type of electronic wristwatch, when the stem is pressed inward to the first position, the magnet provided on the stem separates from the magnetic sensor. Conversely, when the stem is pulled outward to the second position, the magnet moves with the stem and faces the magnetic sensor. Subsequently, when the stem is rotated in this position, the magnet rotates with the stem, and the magnetic field of the rotating magnet is detected by the magnetic sensor. Then, based on this detection data detected by the magnetic sensor, the hands are moved, and as a result, the time is adjusted.

However, a conventional electronic wristwatch such as this is structured such that, when the stem is pulled outward to the second position so that the magnet moves with the stem and faces the magnetic sensor, the magnetic sensor is merely placed near the magnet of the stem. Therefore, the magnetic sensor is easily affected by magnetic fields outside of the wristwatch, which possibly leads to malfunction.

Additionally, in a conventional electronic wristwatch such as this, the magnet is designed larger as a technique for increasing the sensitivity of the magnetic sensor. However, there is a problem in that, when the magnet is designed larger, the thickness of the overall device increases, causing the increase of the overall device size.

SUMMARY OF THE INVENTION

The present invention has been conceived to solve the above-described problems. An object of the present invention is to reduce the thickness and the size of the overall switch and provide a rotation switch of which the magnetic sensor accurately detects the magnetic field of the rotating magnet with high sensitivity, without being affected by external magnetic fields.

In order to achieve the above-described object, one aspect of the present invention includes a rotation switch comprising: an operating member that is operable to rotate; a magnet member that rotates integrally with the operating member; a magnetic sensor that is placed opposite to the magnet member; and a magnetic shield plate having a frame shape that surrounds the periphery of the magnetic sensor.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 12A is an enlarged cross-sectional view of the main section taken along line E-E in FIG. 11, and FIG. 12B is a diagram showing contact point sections of the printed circuit board;

FIG. 13A is an enlarged rear view of the main section of the magnet member in FIG. 3 where the setting lever and the magnet pressing section have been removed, and FIG. 13B is an enlarged cross-sectional view of the main section taken along line F-F in FIG. 13A;

FIG. 14A is an enlarged rear view, FIG. 14B is an enlarged side view, FIG. 14C is an enlarged cross-sectional view taken along line G-G in FIG. 14A, and FIG. 14D is an enlarged cross-sectional view of the magnetic shield plate in FIG. 14C;

FIG. 16A is an enlarged rear view and FIG. 16B is an enlarged cross-sectional view taken along line H-H in FIG. 16A.

DETAILED DESCRIPTION OF THE PREFERRED EMBODIMENTS

The present invention will hereinafter be described in detail with reference to the preferred embodiments shown in the accompanying drawings.

Figure 1:
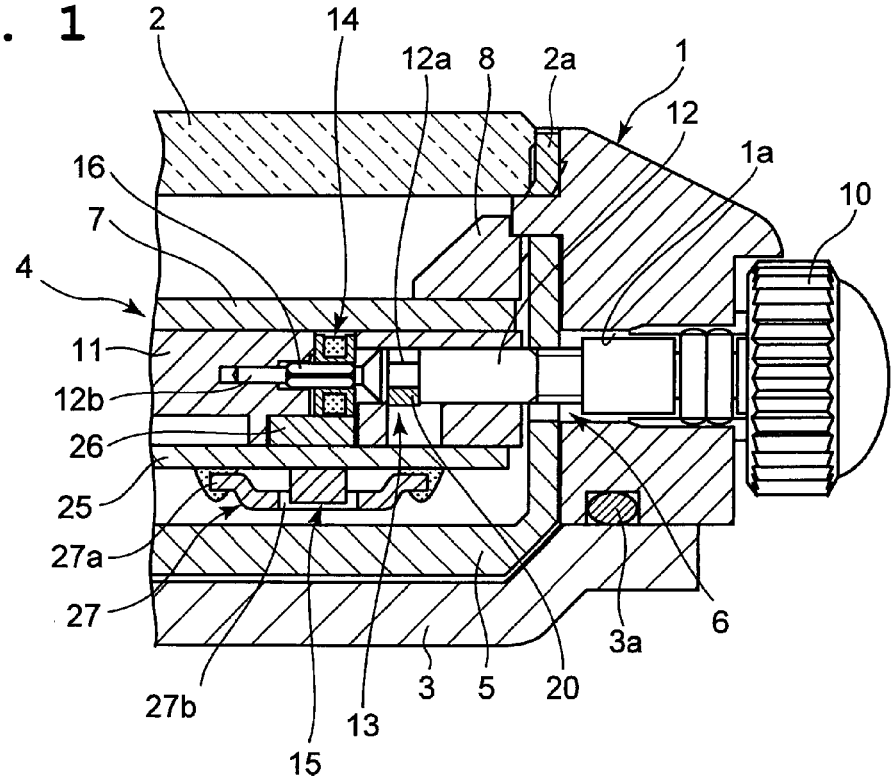
FIG. 1 is an enlarged cross-sectional view showing the main section of an embodiment where the present invention has been applied to an electronic wristwatch.

As shown in FIG. 1, an electronic wristwatch includes a wristwatch case 1. A watch crystal 2 is attached to the upper opening section of this wristwatch case 1 by a gasket 2*a*, and a case back 3 is attached to the bottom section of the wristwatch case 1 by a water-proof ring 3*a*.

Figure 2:
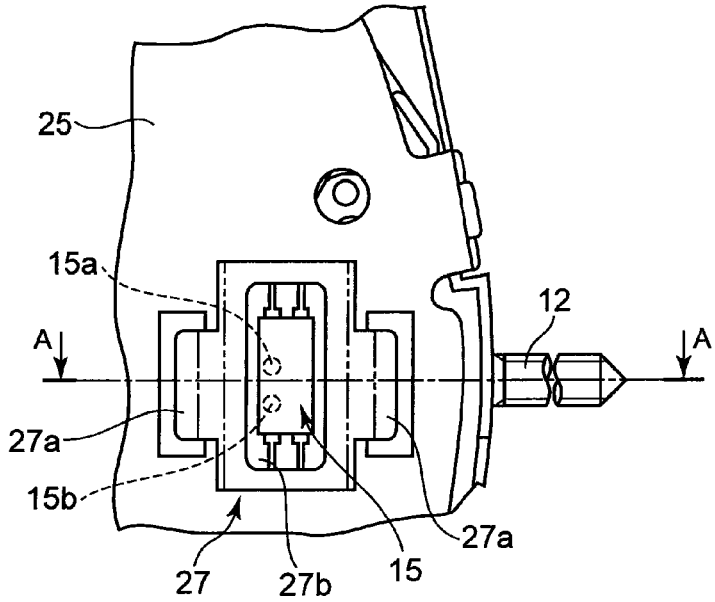
FIG. 2 is an enlarged rear view showing the main section of a timepiece module in the electronic wristwatch in FIG. 1.

Also, as shown in FIG. 1, a timepiece module 4 is provided inside the wristwatch case 1 by a casing ring 5, and as shown in FIG. 1 and FIG. 2, a timepiece movement (not shown) that moves the hands and a time adjusting device 6 that is used for time adjustment are included in this timepiece module 4. In this instance, a dial 7 is provided on the top surface of the timepiece module 4, and a ring-shaped panel member 8 is provided on the top surface of this dial 7.

In addition, as shown in FIG. 1, the time adjusting device 6 includes a crown 10, a stem 12, a position regulating member 13, a magnet member 14, and a magnetic sensor 15. The crown 10 is rotatably inserted into a side wall section of the wristwatch case 1 and projects outward. The stem 12, which is attached to this crown 10, is provided on a main plate 11 inside the timepiece module 4 in a manner to be operable to move in an axial direction and operable to rotate in the direction of rotation around the axis. The position regulating member 13 regulates the movement zone of the stem 12 in an axial direction. The magnet member 14 is slidably provided on the stem 12 and rotates with the stem 12. The magnetic sensor 15 is positioned in the circumferential direction of the magnet member 14 and detects the rotation of the magnet member 14.

In this instance, as shown in FIG. 1, the stem 12 is substantially shaped like a cylindrical bar, and the crown 10 is attached to one end of the stem 12 (right-end portion in FIG. 1). The stem 12 is inserted from the outer side into a through hole la provided in the side wall section of the wristwatch case 1, and as shown in FIG. 1, the other end of the stem 12 (left-end portion in FIG. 1) is attached to the main plate 11 in a manner to be operable to move in an axial direction and operable to rotate in the direction of rotation around the axis. As a result, when the crown 10 positioned outside of the wristwatch case 1 is operated in the direction in which the crown 10 is pulled outward, the stem 12 moves in an axial direction with this operation, and when the crown 10 is operated in the rotation direction, the stem 12 rotates on its axis.

Figure 3:
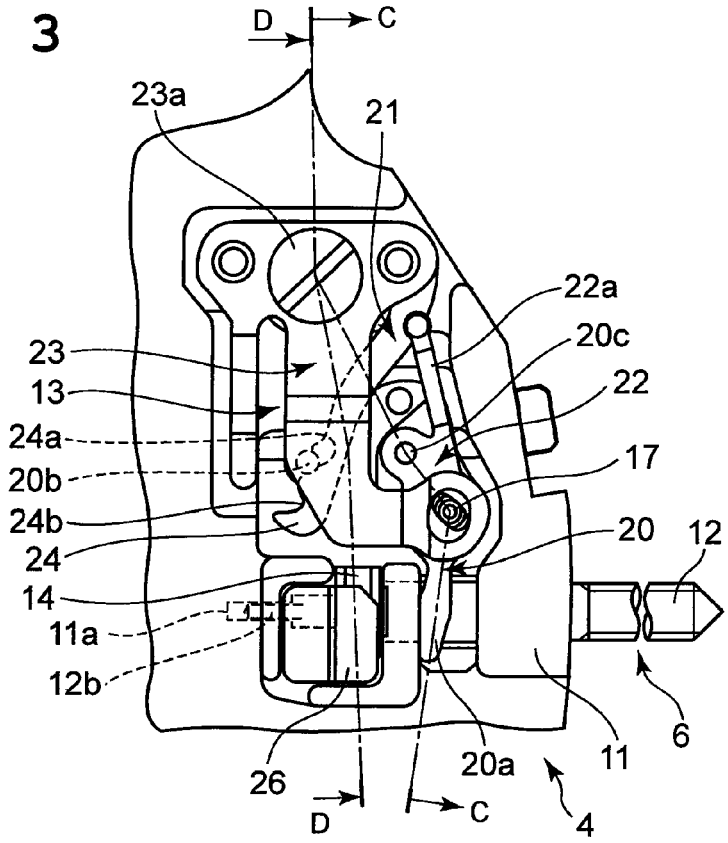
FIG. 3 is an enlarged rear view showing the main section of the timepiece module in FIG. 2 where the printed circuit board has been removed.
Figure 4:
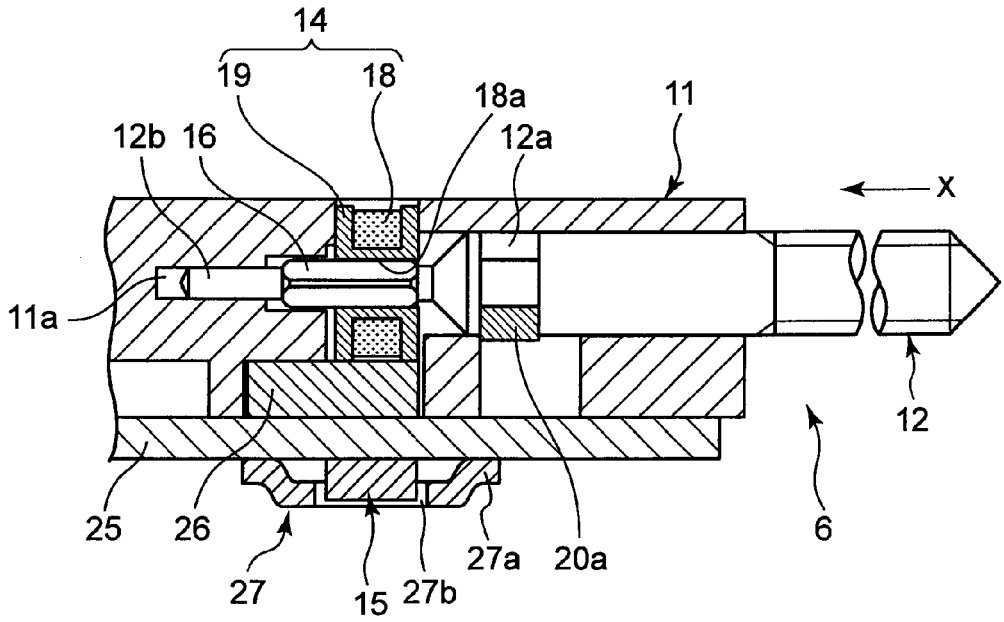
FIG. 4 is an enlarged cross-sectional view taken along line A-A in FIG. 2.
Figure 5:
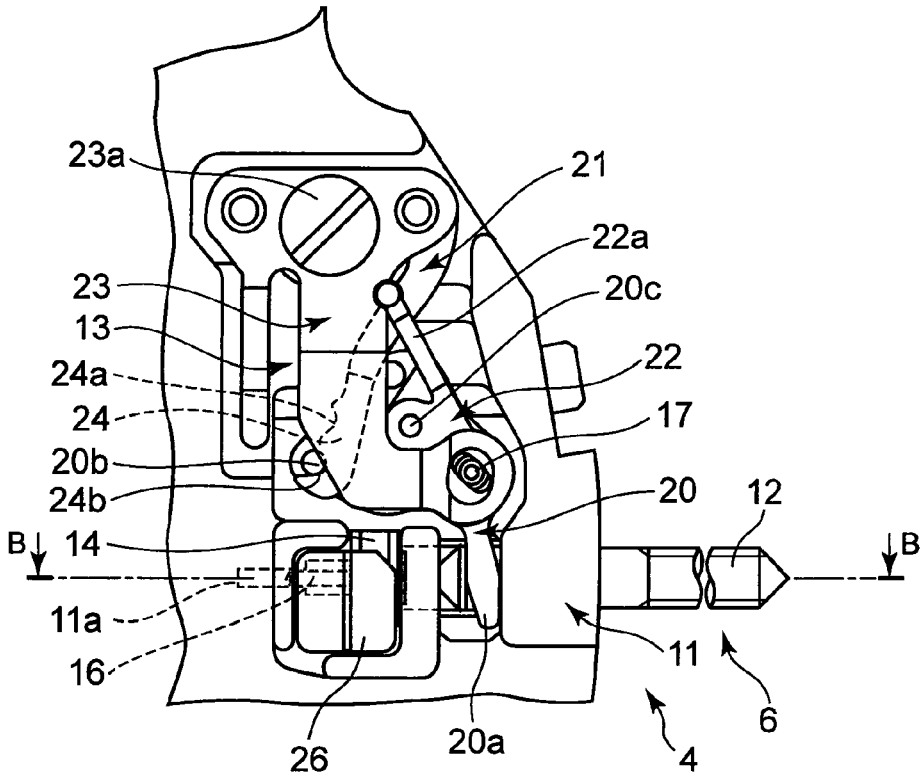
FIG. 5 is an enlarged rear view showing the main section shown in FIG. 3 where a stem has been pulled outward to a second position.
Figure 6:
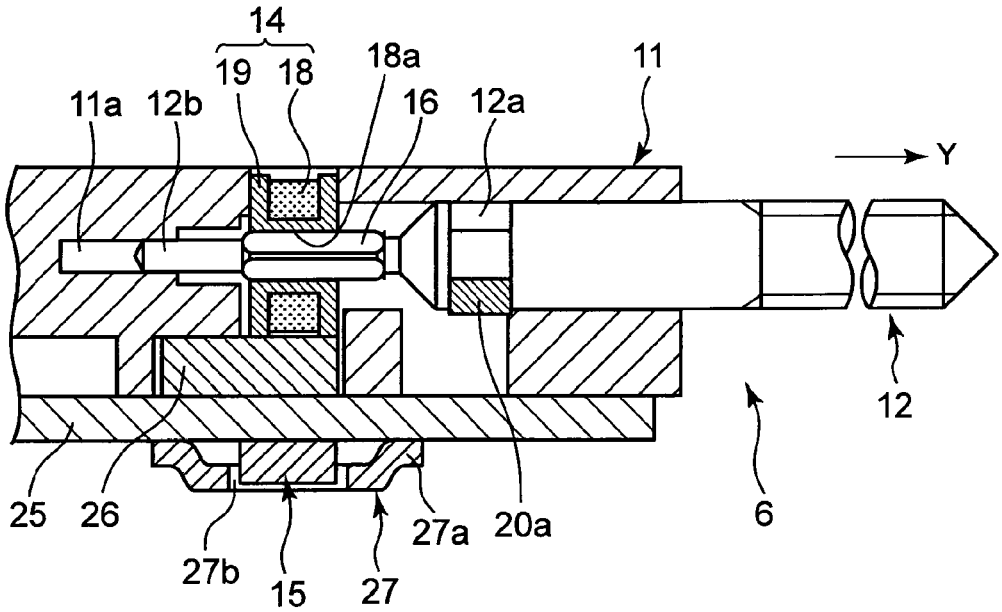
FIG. 6 is an enlarged cross-sectional view taken along line B-B in FIG. 5.

As shown in FIG. 3 to FIG. 6, a small-diameter stepped recess 12*a* is a ring shape formed in a substantially intermediate portion of the stem 12, and as shown in FIG. 4 and FIG. 6, an engaging shaft section 16 is provided on a tip end side (left-end side in FIG. 4) of this stepped recess 12*a* positioned towards the inner side of the timepiece module 4. This engaging shaft section 16 is formed into a rectangular bar with a rectangular cross-sectional shape and is used to slidably attach the magnet member 14 described hereafter.

As shown in FIG. 4 and FIG. 6, a small-diameter shaft section 12*b* is provided on a tip end portion (left-end portion in FIG. 4) of the engaging shaft section 16 positioned towards the inner side of the stem 12. This shaft section 12*b* is formed into a cylindrical bar, and inserted into a guide hole 11*a* provided in the main plate 11 in a manner to be movable in an axial direction and rotatable around the axis. As a result, the stem 12 is configured to move between a first position where the stem 12 has been pressed inward in an axial direction (arrow X direction) as shown in FIG. 4, and a second position where the stem 12 has been pulled outward in an axial direction (arrow Y direction) as shown in FIG. 6.

Figure 7:
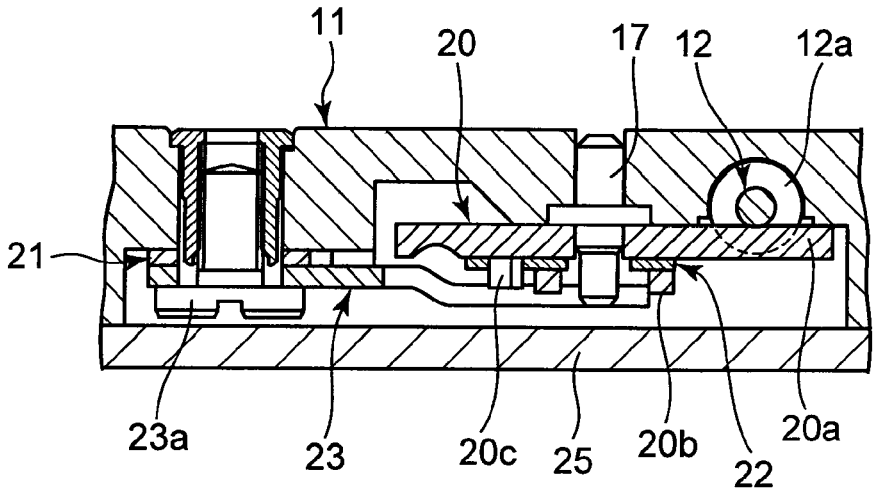
FIG. 7 is an enlarged cross-sectional view taken along line C-C in FIG. 3.
Figure 8:
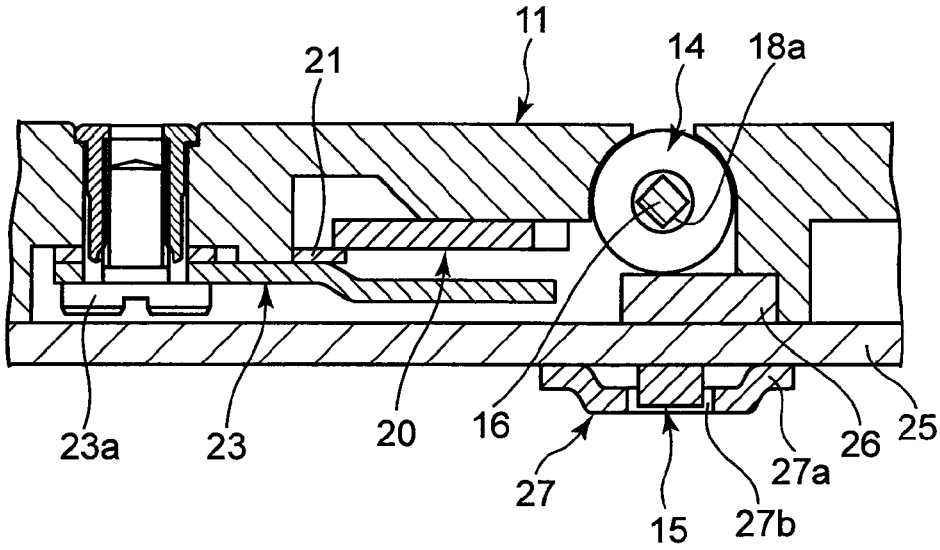
FIG. 8 is an enlarged cross-sectional view taken along line D-D in FIG. 3.
Figure 9:
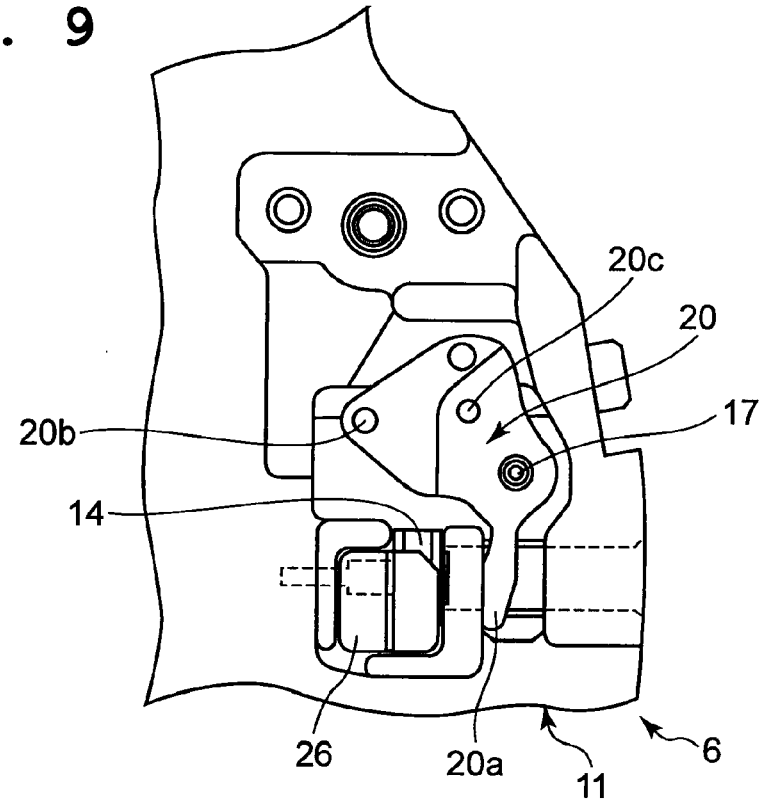
FIG. 9 is an enlarged rear view showing the main section in FIG. 3 where a setting lever has been placed on the main plate.

As shown in FIG. 3 to FIG. 11, the position regulating member 13 includes a setting lever 20, a setting lever spring 21, a switch plate 22, and a pressing plate 23. As shown in FIG. 3 and FIG. 9, the setting lever 20, which is formed into a flat plate, is rotatably attached to a supporting shaft 17 provided on the main plate 11, and rotates around the supporting shaft 17 with the movement of the stem 12 in an axial direction.

Figure 10:
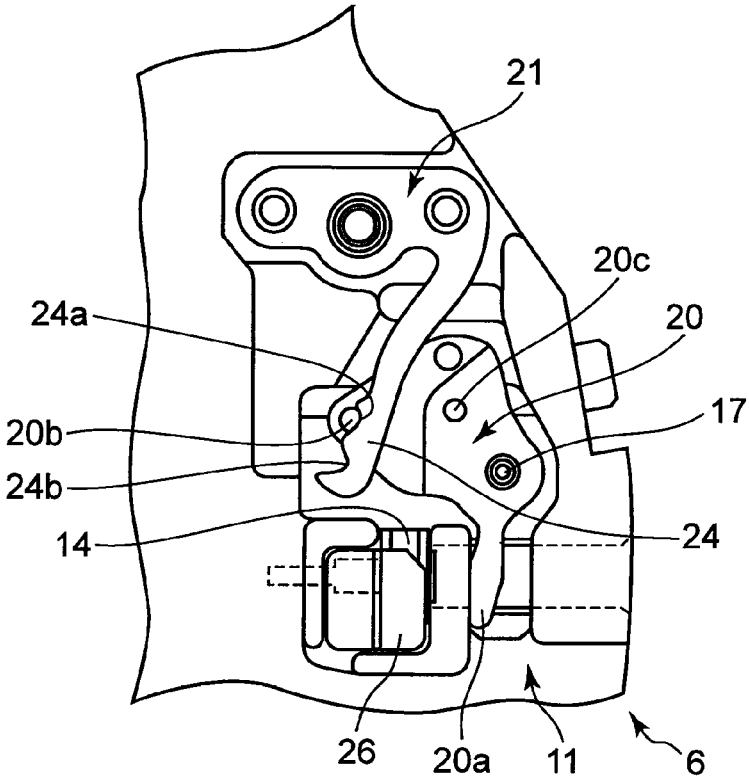
FIG. 10 is an enlarged rear view showing the main section in FIG. 9 where a setting lever spring has been further placed.
Figure 11:
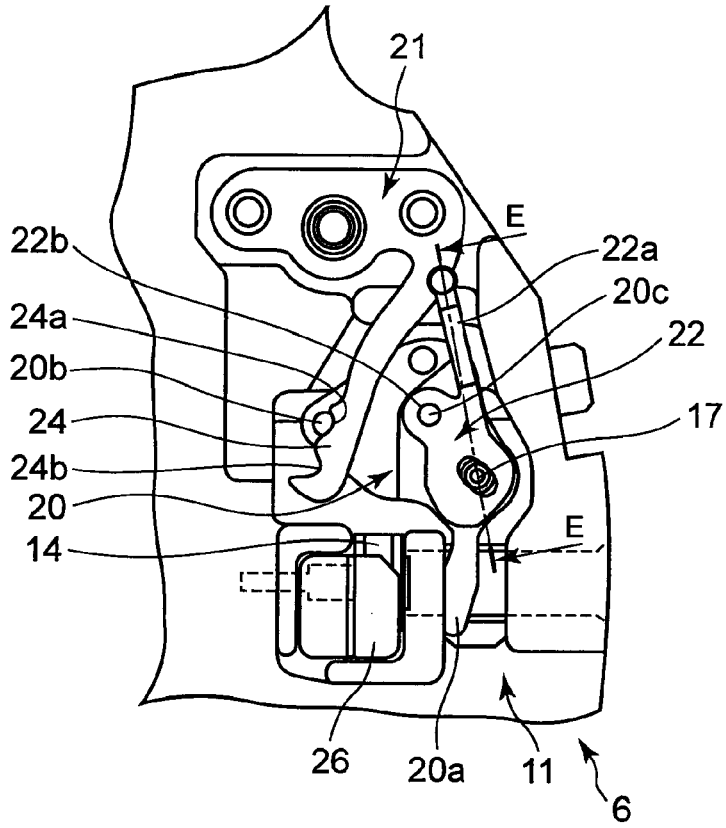
FIG. 11 is an enlarged rear view showing the main section in FIG. 10 where a switch plate has been further placed.

In other words, as shown in FIG. 9 to FIG. 11, the setting lever 20 includes an interlocking arm section 20*a*, an interlocking pin 20*b*, and an interlocking pin 20*c*. The interlocking arm 20*a* is disposed in the stepped recess section 12*a* of the stem 12. Also, the position of the interlocking pin 20*b* is flexibly regulated by the setting lever spring 21. The interlocking pin 20*c* rotates the switch plate 22 with the setting lever 20. Therefore, as shown in FIG. 3 and FIG. 5, the setting lever 20 is configured to rotate around the supporting shaft 17 as a result of the interlocking arm section 20*a* swinging with the movement of the stepped recess section 12*a* of the stem 12, when the stem 12 moves in an axial direction.

As shown in FIG. 7 and FIG. 10, the setting lever spring 21, which is a flat spring that is fixed to the main plate 11 in an area near the setting lever 20, is configured to regulate the rotational position of the setting lever 20 and the movement position of the stem 12 in an axial direction by flexibly holding the interlocking pin 20*b* of the setting lever 20 and regulating the position of the interlocking pin 20*b*. In other words, as shown in FIG. 10, a position regulating section 24 that flexibly holds the interlocking pin 20*b* of the setting lever 20 is provided on a tip end portion of the setting lever spring 21.

As shown in FIG. 10, this position regulating section 24 is provided with a plurality of locking recess sections 24*a* and 24*b* that flexibly lock the interlocking pin 20*b*. As a result, when the stem 12 is pressed inward to the first position as shown in FIG. 4, the setting lever spring 21 regulates the stem 12 to the first position by one locking recess section 24*a* of the position regulating section 24 flexibly locking the interlocking pin 20*b* of the setting lever 20 as shown in FIG. 10.

When the stem 12 is pulled outward in an axial direction to the second position as shown in FIG. 6, the setting lever spring 21 regulates the stem 12 to the second position by the setting lever 20 rotating around the supporting shaft 17, the interlocking pin 20*b* rotates with the rotation of the setting lever 20 and flexibly changes the position regulating section 24, and the other locking recess section 24*b* of the flexibly changed position regulating section 24 flexibly locks the interlocking pin 20*b* of the setting lever 20.

Figure 12A:
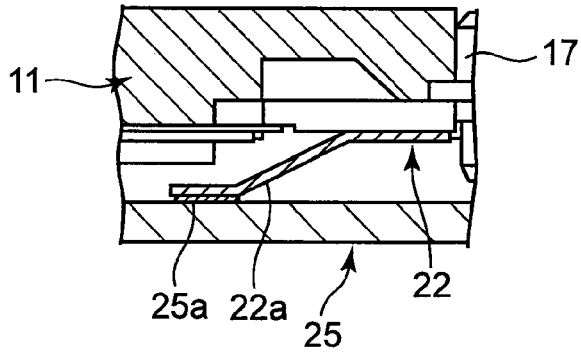
FIG. 12A and FIG. 12B are diagrams showing the switch plate in FIG. 11 and the printed circuit board in an area corresponding thereto, and of these diagrams.

As shown in FIG. 11 and FIG. 12, the switch plate 22 is made of a metal plate and rotatably attached to the supporting shaft 17 of the main plate 11 with the setting lever 20. As shown in FIG. 12A, the switch plate 22 is provided with a contact spring section 22*a* that is in contact with the top surface of a printed circuit board 25 described hereafter and slides. The contact spring section 22*a* is provided extending in a direction opposite to the interlocking arm section 20*a* of the setting lever 20 as shown in FIG. 11. As shown in FIG. 11, an insertion hole 22*b* into which the interlocking pin 20*c* of the setting lever 20 is inserted is provided in a predetermined area of the switch plate 22.

As a result, as shown in FIG. 12A, the switch plate 22 is configured to rotate around the supporting shaft 17 with the setting lever 20, in a state in which the tip end portion of the contact spring section 22*a* is in contact with the top surface of the printed circuit board 25. The tip end portion of the contact spring section 22*a* switches the contact position between contact point sections 25*a* and 25*b* provided on the top surface of the printed circuit board 25. As shown in FIG. 3, FIG. 5 and FIG. 8, the pressing plate 23, which is attached to the main plate 11 with the setting lever spring 21 by a screw 23*a*, presses the setting lever 20 against the main plate 11 by pressing against the setting lever spring 21 and the switch plate 22.

Figure 13A:
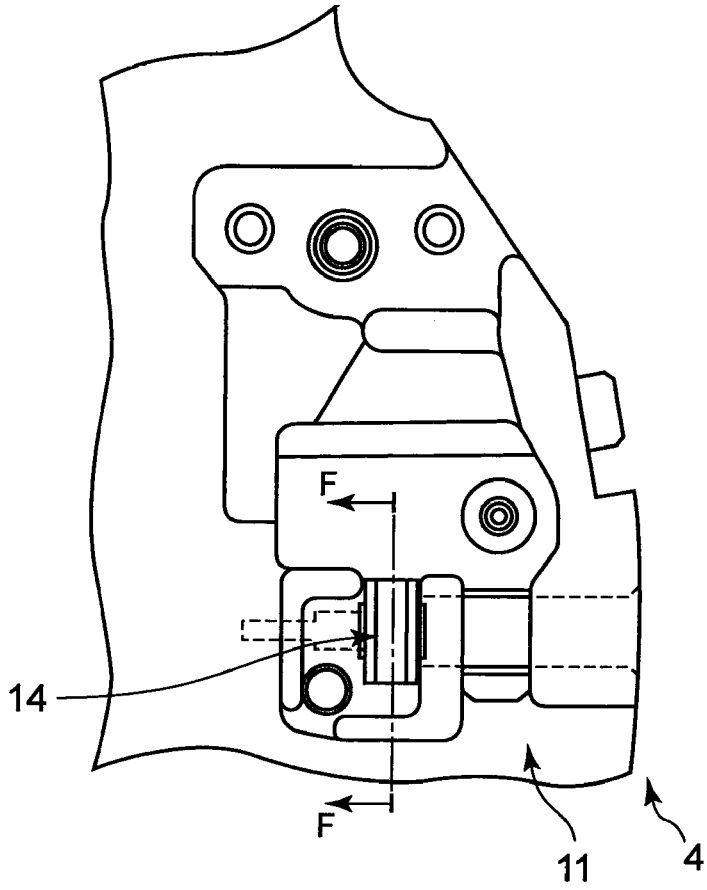
FIG. 13A and FIG. 13B are diagrams showing a magnet member in FIG. 3, and of these diagrams.
Figure 13B:
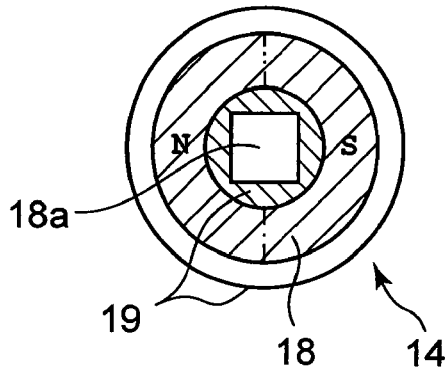

As shown in FIG. 13A and FIG. 13B, the magnet member 14 slidably provided on the stem 12 is constituted by a ring-shaped magnet 18 and a resin section 19 that covers the magnet 18, and the overall magnet member 14 is substantially shaped like a circular plate. An engaging hole 18*a* having a rectangular cross-sectional shape is provided in the center portion of this magnet member 14, and the engaging shaft section 16 of the stem 12 is inserted into this engaging hole 18*a*. As shown in FIG. 4 and FIG. 6, a portion of the outer circumferential surface of the magnet member 14 is pressed by a magnet pressing section 26 provided on the main plate 11.

Therefore, as shown in FIG. 4 and FIG. 6, the magnet member 14 is pressed by the magnet pressing section 26 even when the engaging shaft section 16 of the stem 12 is slidably inserted into the engaging hole 18*a* and the stem 12 moves in an axial direction in this state. As a result, the magnet member 14 moves relative to the stem 12 and is always held at a fixed position. The magnet member 14 rotates with the stem 12 in this state.

In other words, when the stem 12 is pressed inward to the first position as shown in FIG. 3, the magnet member 14 is positioned on the end section side (right side in FIG. 4) of the outer side of the engaging shaft section 16 positioned on the inner side of the stem 12 as shown in FIG. 4. When the stem 12 is pulled outward to the second position as shown in FIG. 5, the magnet member 14 is positioned on the tip end side (left side in FIG. 6) of the inner side of the engaging shaft section 16 positioned on the inner side of the stem 12 as shown in FIG. 6.

As shown in FIG. 1, FIG. 4 and FIG. 6, the magnetic sensor 15 is provided in an area on the bottom surface of the printed circuit board 25 provided on the back surface (lower surface in FIG. 4) of the main plate 11 corresponding to the magnet member 14. Therefore, the magnetic sensor 15 faces the magnet member 14 with the printed circuit board 25 therebetween. The magnetic sensor 15 includes in a single package two magnetic detecting elements such as two magnetoresistance elements (MR elements) 15*a* and 15*b*, and an integrated chip (IC) that digitalizes output. These two MR elements 15*a* and 15*b* detect a change in the magnetic field accompanying the rotation of the magnet member 14, and outputs two types of detection signals: high (H) and low (L).

In other words, because these two MR elements 15*a* and 15*b* in the magnetic sensor 15 are set in different positions, when a change in the magnetic field accompanying the rotation of the magnet member 14 is detected by the magnetic sensor 15, a phase difference occurs in the output. The rotation of the magnet member 14 can be detected by two types of detection signals being outputted because of the phase difference. In this instance, the rotation angle of the magnet member 14 is calculated by the two types of detection signals being analyzed by a microcomputer provided on the printed circuit board 25.

The magnetic sensor 15 also detects the rotation direction of the magnet member 14 (whether the magnet member 14 is rotating in a normal direction or a reverse direction), as well as whether or not a normal rotation or a reverse rotation of the magnet member 14 is continuous. As a result, based on a rotation direction detection signal detected by the magnetic sensor 15, the hands are rotated in a normal direction (clockwise direction) or a reverse direction (counter-clockwise direction). In addition, based on a detection signal detected by the magnetic sensor 15 regarding whether or not the rotation of the magnet member 14 is continuous, when the rotation is continuous, the hands are rotated in a normal direction (clockwise direction) or a reverse direction (counter-clockwise direction) at a high speed.

In this instance, as shown in FIG. 1 and FIG. 14A to FIG. 14D, a magnetic shield plate 27, which is made of a magnetic material such as low-carbon steel (SPCC), is placed surrounding the magnetic sensor 15. As shown in FIG. 14A to FIG. 14D, the overall magnetic shield plate 27 is substantially shaped like a flat, frame-shaped plate. An attaching section 27*a* bent upwards at an angle is formed on both side portions of the magnetic shield plate 27, and each bent attaching section 27*a* is attached to the bottom surface of the printed circuit board 25 by a solder 28.

Figure 14A:
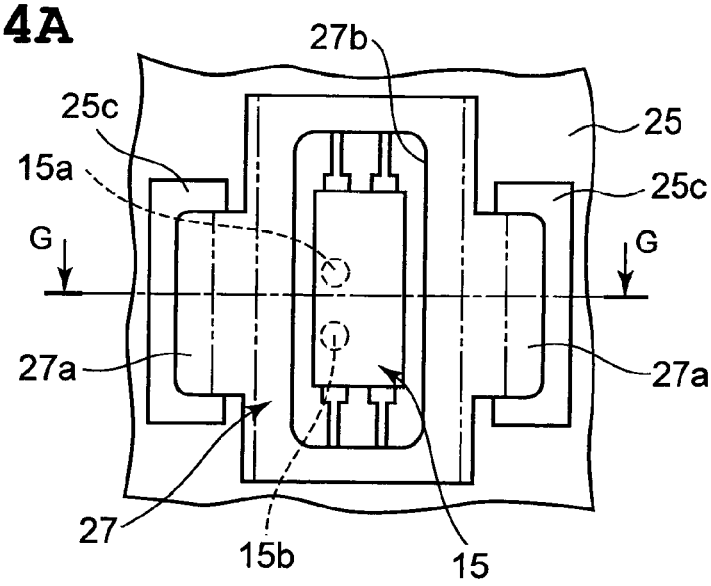
FIG. 14A to FIG. 14D are diagrams showing a magnetic sensor and a magnetic shield plate of FIG. 2, and of these diagrams.
Figure 14B:
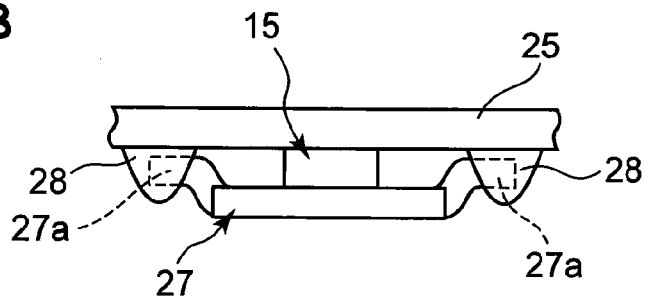
Figure 14C:
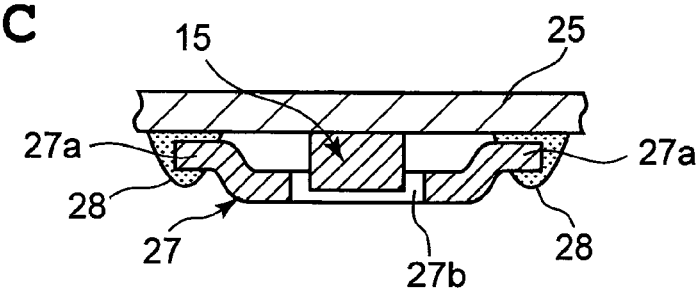
Figure 14D:
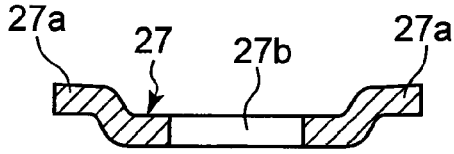

Also, in this instance, as shown in FIG. 14C, an opening section 27*b* is provided on the magnetic shield plate 27, and the bottom portion of the magnetic sensor 15 is inserted into this opening section 27*b* without protruding from the bottom side thereof. As a result, as shown in FIG. 14C, the magnetic shield plate 27 surrounds the periphery of the magnetic sensor 15 provided on the bottom surface of the printed circuit board 25. In addition, the attaching sections 27*a* of the magnetic shield plate 27 are attached by the solder 28 to electrodes 25*c* connected to a ground (reference potential) on the bottom surface of the printed circuit board 25.

Various electronic components (not shown) required by a timepiece function, such as an integrated circuit device (IC and large scale integration [LSI]), are provided on the printed circuit board 25. Also, wiring patterns (not shown) made of metal, such as copper foil, are formed on the top and bottom surfaces of the printed circuit board 25. In this instance, the wiring patterns (not shown) are not formed on the printed circuit board 25 in the area between the magnetic sensor 15 and the magnet member 14.

Next, operations of the electronic wristwatch will be described.

First, when the stem 12 is moved to the first position by being pressed inward in an axial direction, as shown in FIG. 3 and FIG. 4, the stepped recess section 12*a* of the stem 12 moves to the inner side of the timepiece module 4 (left side in FIG. 4) and the engaging shaft section 16 of the stem 12 is pressed in the arrow X direction shown in FIG. 4. In this state, because the magnet member 14 is being pressed by the magnet pressing section 26, the magnet member 14 does not move with the stem 12 even when the stem 12 is pressed inward. The magnet member 14 is positioned on the end section side (right side in FIG. 4) on the outer side of the engaging shaft section 16 of the stem 12 and faces the magnetic sensor 15.

At this time, because the stepped recess section 12*a* of the stem 12 moves towards the inner side of the timepiece module 4, as shown in FIG. 9, the interlocking arm section 20*a* of the setting lever 20 moves towards the inner side (right side in FIG. 9) of the timepiece module 4, and the setting lever 20 rotates around the supporting shaft 17 in the clockwise direction. With the rotation of the setting lever 20, as shown in FIG. 3 and FIG. 10, the interlocking pin 20*a* is flexibly held by one locking recess section 24*a* of the position regulating section 24 provided on the setting lever spring 21. As a result, the stem 12 is regulated to the first position to which the stem 12 has been pressed inward.

In addition, at this time, because the switch plate 22 is connected to the setting lever 20 by the interlocking pin 20*c* of the setting lever 20, as shown in FIG. 11, the switch plate 22 rotates with the setting lever 20 around the supporting shaft 17 in the clockwise direction. As a result, the switch plate 22 rotates with the tip end portion of the contact spring section 22*a* of the switch plate 22 being in contact with the top surface of the printed circuit board 25, as shown in FIG. 12A.

Figure 12B:
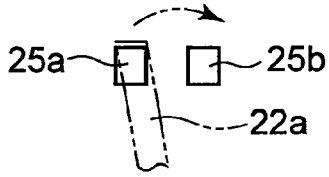

As a result, as shown in FIG. 12B, the contact spring section 22*a* moves to one contact point section 25*a* (left side in FIG. 12B) of the printed circuit board 25 and comes into contact with the contact point section 25*a*, thereby turning OFF the magnetic sensor 15. In the OFF state, magnetic detection by the magnetic sensor 15 is stopped. Therefore, even when the stem 12 is rotated and the magnet member 14 rotates, the magnetic sensor 15 does not detect the rotation magnetic field of the magnet member 14.

Conversely, when the stem 12 is moved to the second position by being pulled outward in an axial direction, as shown in FIG. 5 and FIG. 6, the stepped recess section 12*a* of the stem 12 moves towards the outer side of the timepiece module 4, and the engaging shaft section 16 of the stem 12 moves in the direction in which the stem 12 is pulled (right direction indicated by arrow Y in FIG. 6). At this time as well, the magnet member 14 is being pressed by the magnet pressing section 26. Therefore, even when the stem 12 moves in the direction in which the stem 12 is pulled, the magnet member 14 does not move with the stem 12. The magnet member 14 is positioned on the tip end side (left side in FIG. 6) on the inner side of the engaging shaft section 16 of the stem 12.

At this time, as shown in FIG. 6, because the stepped recess section 12*a* of the stem 12 moves towards the outer side of the timepiece module 4 (right side in FIG. 6), the interlocking arm section 20*a* of the setting lever 20 moves towards the outer side of the timepiece module 4, and the setting lever 20 rotates around the supporting shaft 17 in a counter-clockwise direction. With the rotation of the setting lever 20, as shown in FIG. 5, the interlocking pin 20*a* is flexibly held by the other locking recess section 24*b* of the position regulating section 24 provided on the setting lever spring 21. As a result, the stem 12 is regulated to the second position in which the stem 12 has been pulled outward.

At this time as well, because the switch plate 22 is connected to the setting lever 20 by the interlocking pin 20*c* of the setting lever 20, as shown in FIG. 5, the switch plate 22 rotates with the setting lever 20 around the supporting shaft 17 in the counter-clockwise direction. As a result, the switch plate 22 rotates in a direction opposite to that described above with the tip end portion of the contact spring section 22*a* of the switch plate 22 being in contact with the printed circuit board 25, as shown in FIG. 12A. As a result, as shown in FIG. 12B, the tip end portion moves to the other contact point section 25*b* (right side in FIG. 12B) of the printed circuit board 25 and comes into contact with the contact point section 25*b*, thereby turning ON the magnetic sensor 15 to enable magnetic detection by the magnetic sensor 15.

When the stem 12 is rotated in this state, the magnet member 14 rotates with the stem 12, causing a change in the magnetic field which is detected by the magnetic sensor 15. At this time, as shown in FIG. 1 and FIG. 14C, the periphery of the magnetic sensor 15 is surrounded by the magnetic shield plate 27. Therefore, the magnetic sensor 15 accurately detects only the rotation magnetic field of the magnet member 14 with high sensitivity without being affected by magnetic fields outside of the wristwatch case 1, and outputs a detection signal.

This detection signal outputted from the magnetic sensor 15 is analyzed by the microcomputer on the printed circuit board 25, and the hands (not shown) are moved depending on the rotation of the stem 12 for time adjustment. At this time, the magnetic sensor 15 also detects the rotation direction of the magnet member 14 (whether the magnet member 14 is rotating in the normal direction or the reverse direction), and the hands are moved in the normal direction (clockwise direction) or the reverse direction (counter-clockwise direction) for time adjustment.

At this time, when the magnetic sensor 15 detects that the normal rotation or the reverse rotation of the magnet member 14 is continuous, the hands are moved in the normal direction (clockwise direction) or the reverse direction (counter-clockwise direction) at a high speed. As a result, the time is quickly adjusted. When the stem 12 is not rotated for a period of several tens of seconds in the second position to which the stem 4 has been pulled outward, the magnetic sensor 15 enters an OFF state, and power consumption is prevented.

As just described, in this electronic wristwatch, since the magnetic shield plate 27 surrounds the periphery of the magnetic sensor 15 placed facing the magnet member 14 which rotates integrally with the stem 12 that is a rotatable operating member, external magnetic fields can be absorbed by the magnetic shield plate 27. Therefore, the magnet member 14 is not required to be designed larger for increasing the sensitivity of the magnetic sensor 15. As a result, the overall thickness of the wristwatch is not increased even when the magnetic shield plate 27 is provided, and miniaturization and thinning of wristwatch can be achieved. In addition, since the magnetic sensor 15 is not affected by external magnetic fields, the magnetic field of the magnet member 14 rotating with the stem 12 can be accurately detected by the magnetic sensor 15 with high sensitivity.

In this instance, the overall magnetic shield plate 27 is substantially shaped like a flat, frame-shaped plate surrounding the overall periphery of the magnetic sensor 15. Therefore, the infiltration of external magnetic fields from the overall outer periphery of the magnetic sensor 15 can be infallibly prevented. As a result, the sensitivity of the magnetic sensor 15 can be further enhanced, and the magnetic field of the magnet sensor 14 rotating with the stem 12 can be more accurately detected with higher sensitivity. When the magnetic shield plate 27 is formed so as to cover the overall bottom surface of the magnetic sensor 15 (the surface opposite to the printed circuit board 25), the magnetic shield plate 27 also absorbs the magnetic field of the magnet member 14 that should be detected by the magnetic sensor 15. Therefore, the magnet member 14 is required to be designed larger. However, in the present invention, the magnetic shield plate 27 is formed in a manner to surround the magnetic sensor 15. Therefore, the magnet member 14 is not required to be designed larger, and as a result, the miniaturization and thinning of wristwatch can be achieved.

Also, in the present invention, the overall magnetic shield plate 27 is substantially shaped like a flat, frame-shaped plate, and the opening section 27*b* into which the bottom portion of the magnetic sensor 15 in the thickness direction is inserted without protruding from the bottom side thereof is provided in the center portion of the magnetic shield plate 27. Therefore, the bottom portion of the magnetic sensor 15 can be inserted into the opening section 27*b*of the magnetic shield plate 27 even when the magnetic shield plate 27 surrounds the periphery of the magnetic sensor 15, and the thickness of the timepiece module 4 does not increase because of this. As a result, the overall thickness of the wristwatch can be further reduced, and the overall size of the wristwatch can be further reduced.

In addition, since the periphery of the magnetic sensor 15 is surrounded by the magnetic shield plate 27, the influence of a magnetic field generated by a stepping motor (not shown)

embedded in the timepiece movement (not shown) can be infallibly prevented. Accordingly, the magnetic sensor 15 can more accurately detect the rotation of the magnet member 14 with higher sensitivity.

Moreover, in this electronic wristwatch, since the engaging shaft section 16, which has a non-circular cross-sectional shape, of the stem 12 engages with the engaging hole 18*a* of the magnet member 14, the magnet member 14 can be moved in relation to the stem 12 when the stem 12 is moved in an axial direction. Accordingly, the magnet member 14 can be constantly held in a fixed position in relation to an axial direction of the stem 12.

Therefore, even when the stem 12 is moved in an axial direction, the magnet member 14 can constantly face the magnetic sensor 15 without the stem 12 or the magnet member 14 being damaged. Accordingly, even when the stem 12 is moved to a plurality of positions in an axial direction, the rotation of the stem 12 can be accurately detected by a single magnetic sensor 15. In addition, since the magnetic sensor 15 is not in contact with the magnet member 14, a highly durable electronic wristwatch can be provided.

Furthermore, in this instance, the time can be adjusted such that, after the rotation of the magnet member 14 is detected and a detection signal is outputted by the magnetic sensor 15, the outputted detection signal is analyzed by the microcomputer on the printed circuit board 25, and the hands (not shown) are moved depending on the rotation of the stem 12. At this time, since the magnetic sensor 15 detects the rotation direction (normal rotation or reverse rotation) of the magnet member 14, the hands can be rotated in the normal direction (clockwise direction) or the reverse direction (counter-clockwise direction).

Also, at this time, the magnetic sensor 15 detects whether or not the normal rotation or the reverse rotation of the magnet member 14 is continuous, and when the rotation is continuous, the time can be quickly adjusted by the hands being rotated in the normal direction (clockwise direction) or the reverse direction (counter-clockwise direction) at a high speed.

Still further, this electronic wristwatch includes the position regulating member 13 that regulates the position of the stem 12 in an axial direction to the first position and the second position. Therefore, the stem 12 can be accurately and infallibly regulated to the first position and the second position in an axial direction of the stem 12. Specifically, the position regulating member 13 includes the setting lever 20 that rotates with the movement of the stem 12 in an axial direction, and the setting lever spring 21 that flexibly holds the interlocking pin of the setting lever 20 by the locking recess sections 24*a* and 24*b* of the position regulating section 24. Therefore, the position regulating section 24 of the setting lever spring 21 can regulate the rotation position of the setting lever 20, thereby infallibly regulating the position of the stem 12 in an axial direction.

Yet still further, since the stem 12 includes the switch plate 22 that is a contact point switching member for switching between the contact point sections 25*a* and 25*b* of the printed circuit board 25 based on the position of the stem 12 which is the first position where the stem 12 has been pushed inward in an axial direction or the second position where the stem 12 has been pulled outward in an axial direction, even when the magnet member 14 constantly faces the magnetic sensor 15, the magnetic sensor 15 can be switched ON and OFF by the contact point sections 25*a* and 25*b* of the printed circuit board 25 being switched by the switch plate 22.

Specifically, since the switch plate 22 can rotate with the setting lever 20 that rotates with the movement of the stem 12 in an axial direction, and the contact spring section 22*a* can switch between the contact point sections 25*a* and 25*b* of the printed circuit board 25, when the stem 12 is pushed inward to the first position, the contact spring section 22*a* comes into contact with one contact point section 25*a*, and the magnetic sensor 15 is turned OFF. Also, when the stem 12 is pulled outward to the second position, the contact spring section 22*a* comes into contact with the other contact point section 25*b*, and the magnetic sensor 15 is turned ON.

Therefore, when the stem 12 is pushed inward to the first position, the magnetic sensor 15 is turned OFF, thereby preventing idle current to the magnetic sensor 15. Even when the stem 12 is rotated and the magnet member 14 is rotated in this state, the magnetic sensor 15 does not detect the rotation of the magnet member 14, and therefore power consumption by the magnetic sensor 15 can be reduced.

Conversely, when the stem 12 is pulled outward to the second position, the magnetic sensor 15 is turned ON. Therefore, when the magnet member 14 is rotated by the stem 12 being rotated, the magnetic sensor 15 can detect the rotation of the magnet member 14. In this instance, when the stem 12 is not rotated for a period of several tens of seconds in the second position to which the stem 4 has been pulled outward, the magnetic sensor 15 is turned OFF, and power consumption by the magnetic sensor 15 can be further reduced thereby. As a result, lower power consumption is achieved.

Yet still further, in this electronic wristwatch, the magnetic sensor 15 is provided on the printed circuit board 25 of the timepiece module 4 inside the wristwatch case 1 in a manner to face the magnet member 14 with this printed circuit board 25 being interposed therebetween. Therefore, the magnetic sensor 15 can be apposed to various electronic components, such as integrated circuit devices (IC and LSI) mounted on the printed circuit board 25, required by the timepiece function. Accordingly, high-density packaging is possible, and thereby achieving the miniaturization and thinning of the timepiece module 4.

In this instance, the wiring patterns formed by metal such as copper foil are provided on both top and bottom surfaces of the printed circuit board 25. However, the wiring patterns are not provided on the printed circuit board 25 in the area between the magnetic sensor 15 and the magnet member 14. Therefore, the magnetic sensor 15 can accurately detect the rotation of the magnet member 14 with high sensitivity, without being affected by the wiring patterns formed from metal such as copper foil.

Figure 15:
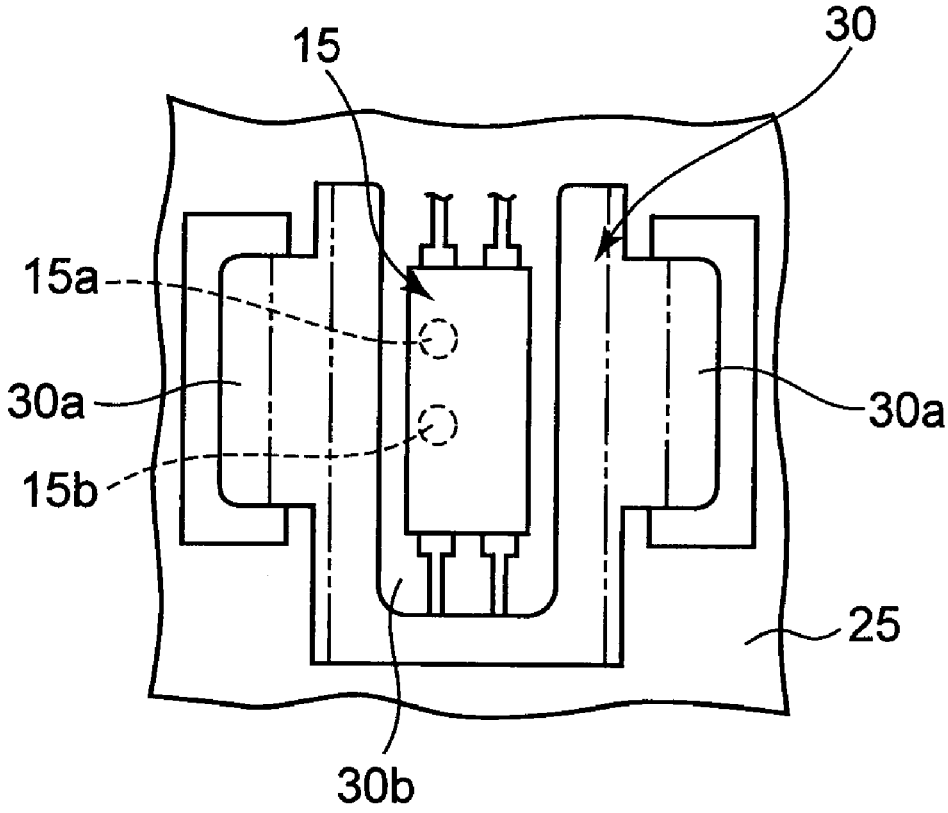
FIG. 15 is an enlarged rear view showing a variation example of the magnetic shield plate.

Note that, in the above-described embodiment, the overall magnetic shield plate 27 is substantially shaped like a flat, frame-shaped plate so as to surround the overall magnetic sensor 15. However, the present invention is not limited thereto. For example, as in a variation example shown in FIG. 15, a magnetic shield plate 30 of which the overall shape is substantially a flat, frame-shaped plate may be formed so as to surround three edges of the magnetic sensor 15, excluding a portion, namely an upper edge side, of the overall periphery of the magnetic sensor 15.

In this instance as well, an attaching section 30*a* bent upwards at an angle is formed on both sides of the magnetic shield plate 30, and each bent attaching section 30*a* is attached to an electrode 25*c* on the bottom surface of the printed circuit board 25 by a solder 28. In addition, the magnetic shield plate 30 is provided with an opening section 30*b* into which the bottom portion of the magnetic sensor 15 in the thickness direction is inserted without protruding from the bottom side thereof. Configurations of the magnetic shield plate 30 such as this also achieve effects similar to those achieved by the above-described embodiment.

Figure 16A:
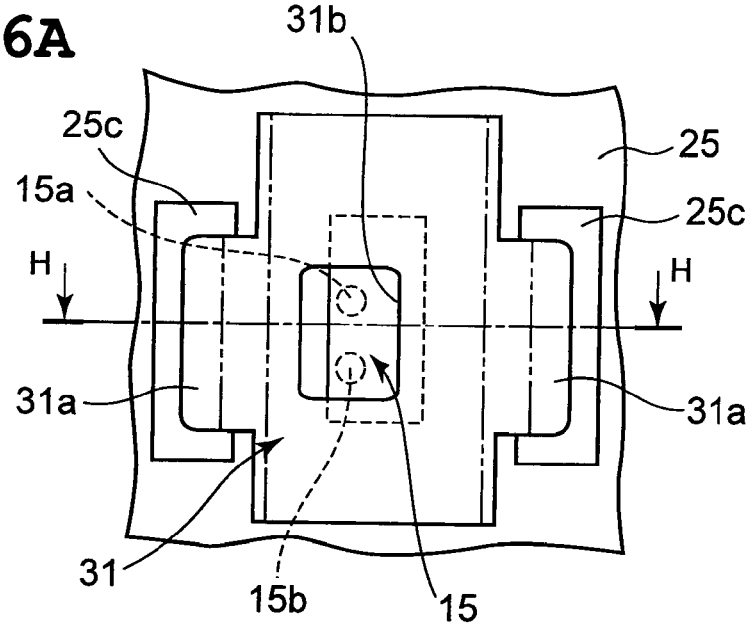
FIG. 16A and FIG. 16B are diagrams showing a variation example of the magnetic shield plate, and of these diagrams
Figure 16B:
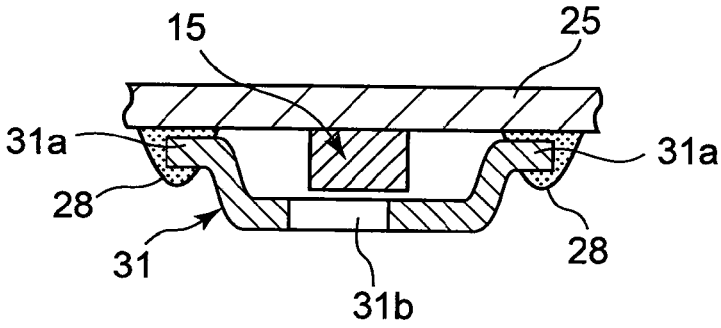

In the above-described embodiment, the opening section 27*b* which is larger than the magnetic sensor 15 is formed in the magnetic shield plate 27, and a portion of the magnetic sensor 15 is inserted therein. However, the present invention is not limited thereto. For example, as in another variation example shown in FIG. 16A and FIG. 16B, an opening section 31*b* may be formed in only portions of an a magnetic shield plate 31 that correspond to the MR elements 15*a* and 15*b* inside the magnetic sensor 15, and the periphery of the magnetic sensor 15 may be surrounded by the magnetic shield plate 31.

Also, in the above-described embodiment, the engaging shaft section 16 having a rectangular cross-section is provided on the stem 12, and a rectangular engaging hole 18*a* into which the engaging shaft section 16 of the stem 12 is inserted is provided in the center of the magnet member 14. However, the present invention is not limited thereto. The engaging shaft section 16 of the stem 12 and the engaging hole 18*a* of the magnet member 14 may be polygonal such as triangular, pentagonal, or hexagonal, or non-circular such as elliptical or spline-shaped.

Moreover, in the above-described embodiment, the magnet member 14 is constituted by the magnet 18 and the resin section 19 which covers this magnet 18. However, the present invention is not limited thereto. For example, the magnet 18 may be protected by being covered by an exterior made of a magnetic material. In a configuration such as this, a small magnet 18 may be used, thereby achieving the miniaturization of the overall magnet member 14.

Furthermore, in the above-described embodiment, a configuration is described in which the stem 12 moves between the first position and the second position in an axial direction. However, the configuration is not necessarily required to be that in which the stem 12 moves only between the first position and the second position. The stem 12 may be pulled further outward from the second position and moved to a third position. In this configuration as well, the magnet member 14 does not move with the pulling operation of the stem 12 in an axial direction because the magnet member 14 is pressed by the magnet pressing section 26, and always corresponds to a single magnetic sensor 15. Therefore, the rotation of the stem 12 can be detected by the single magnetic sensor 15.

Lastly, in the above-described embodiment and in each variation example of the embodiment, a case where the present invention is applied to a dial-type electronic wristwatch is described. However, the present invention is not limited to the above-described embodiments. In other words, the present invention may be applied to various electronic timepieces such as a travel clock, an alarm clock, a mantelpiece clock and a wall clock. In addition, the present invention may be widely applied to electronic devices such as a mobile phone and personal a digital assistants (PDA) besides electronic timepieces.

While the present invention has been described with reference to the preferred embodiments, it is intended that the invention be not limited by any of the details of the description therein but includes all the embodiments which fall within the scope of the appended claims.

What is claimed is:

1. A rotation switch comprising:

an operating member that is operable to rotate;

a magnet member that rotates integrally with the operating member;

a magnetic sensor that is placed operationally opposite to the magnet member;

a magnetic shield plate having a frame shape that surrounds at least part of a periphery of the magnetic sensor; and a printed circuit board that is provided between the magnet member and the magnetic sensor such that the magnetic sensor is provided on a first surface of the printed circuit board which is opposite from a second surface of the printed circuit board that faces the magnet member, wherein the magnetic shield plate overall has a substantially flat, frame-shape and is attached to the first surface of the printed circuit board, and wherein an opening is provided in the magnetic shield plate, and the magnetic sensor is inserted in the opening without protruding through the opening from the magnetic shield plate.

2. The rotation switch according to claim 1, wherein the magnetic shield plate surrounds an entire periphery of the magnetic sensor.

3. The rotation switch according to claim 1, wherein the magnetic shield plate surrounds the periphery of the magnetic sensor excluding a portion of the periphery.

4. The rotation switch according to claim 1, wherein the magnetic shield plate includes a frame-shaped section that surrounds at least the part of the periphery of the magnetic sensor, and an attaching section which is formed by bending the frame-shaped section and which is fixed to the printed circuit board.

5. The rotation switch according to claim 1, wherein an electrode is formed on the printed circuit board, and the magnetic shield plate is attached to the electrode by a solder.

6. An electronic timepiece comprising:

a timepiece case;

an operating member that is operable to rotate and is rotatably inserted in a through hole in the timepiece case;

a magnet member that is provided inside the timepiece case and rotates integrally with the operating member;

a magnetic sensor that is placed operationally opposite to the magnet member;

a magnetic shield plate having a frame shape that surrounds at least part of a periphery of the magnetic sensor; and a printed circuit board that is provided between the magnet member and the magnetic sensor such that the magnetic sensor is provided on a first surface of the printed circuit board which is opposite from a second surface of the printed circuit board that faces the magnet member, wherein the magnetic shield plate overall has a substantially flat, frame-shape and is attached to the first surface of the printed circuit board, and wherein an opening is provided in the magnetic shield plate, and the magnetic sensor is inserted in the opening without protruding through the opening from the magnetic shield plate.

7. The electronic timepiece according to claim 6, wherein the magnetic shield plate surrounds an entire periphery of the magnetic sensor.

8. The electronic timepiece according to claim 6, wherein the magnetic shield plate surrounds the periphery of the magnetic sensor excluding a portion of the periphery.

9. The electronic timepiece according to claim 6, wherein the magnetic shield plate includes a frame-shaped section that surrounds at least the part of the periphery of the magnetic sensor, and an attaching section which is formed by bending the frame-shaped section and which is fixed to the printed circuit board.

10. The electronic timepiece according to claim 6, wherein an electrode is formed on the printed circuit board, and the magnetic shield plate is attached to the electrode by a solder.

* * * * *

UNITED STATES PATENT AND TRADEMARK OFFICE

CERTIFICATE OF CORRECTION

PATENT NO. : 8,220,987 B2
APPLICATION NO. : 12/791189
DATED : July 17, 2012
INVENTOR(S) : Soh Kimura It is certified that error appears in the above-identified patent and that said Letters Patent is hereby corrected as shown below:

On the Title page:

Item (73) Assignee;

change "Casio Computer., Ltd" to --Casio Computer Co., Ltd--.

Signed and Sealed this
Fourth Day of December, 2012

David J. Kappos

David J. Kappos
*Director of the United States Patent and Trademark Office*